United States Patent [19]

Bradberry

[11] Patent Number: 4,787,781

[45] Date of Patent: Nov. 29, 1988

[54] SHORING DEVICE

[75] Inventor: George Bradberry, Hebert, La.

[73] Assignee: Walter Lipscomb, Dallas, Tex. ; a part interest

[21] Appl. No.: 50,088

[22] Filed: May 14, 1987

[51] Int. Cl.[4] ..... E02D 17/04

[52] U.S. Cl. ..... 405/282; 254/93 R

[58] Field of Search ..... 405/272, 282, 283; 248/354.3; 254/93 R, 93 A

[56] References Cited

U.S. PATENT DOCUMENTS

| | | | |
|---|---|---|---|
| 891,897 | 6/1908 | Astrom | 405/282 X |
| 2,372,196 | 3/1945 | Grime . | |
| 2,408,181 | 9/1946 | Simonton . | |
| 3,321,182 | 5/1967 | Elenburg . | |
| 3,335,573 | 7/1967 | Ward . | |
| 3,347,049 | 10/1967 | Faltersack et al. | 405/282 |
| 3,851,856 | 12/1974 | Berg . | |
| 3,905,279 | 9/1975 | Yadon . | |
| 4,247,082 | 1/1981 | Sjolund . | |
| 4,449,734 | 5/1984 | Cory . | |

*Primary Examiner*—David H. Corbin

*Attorney, Agent, or Firm*—Vaden, Eickenroth, Thompson & Boulware

[57] ABSTRACT

There is disclosed a device for shoring the side walls of a trench or the like which includes a pair of elongate rails and a pair of parallel, hydraulically extendible and contractible actuators connected at opposite ends to the rails for lowering with the rails into and out of positions between the walls of the trench, and adapted, when extended, to hold the rails tightly against the walls.

3 Claims, 2 Drawing Sheets

SHORING DEVICE

This invention relates to a device for shoring the side walls of a trench or the like. More particularly, it relates to an improved shoring device of the type having a pair of elongate rails and a pair of parallel, hydraulically extendible and contractible actuators connected at opposite ends to the rails for lowering with the rails into and out of positions between the walls, and adapted, when extended, to hold the rails tightly against the walls.

In conventional shoring devices of this type, each actuator includes a cylinder connected to one rail and a piston on a rod connected to the other rail and sealably reciprocable within the cylinder to form a pressure chamber between one end of the piston and a closed end of the cylinder adjacent its connection to the one rail. Thus, each cylinder has a passageway therein connecting the pressure chamber with a fitting to which a hose may be connected for introducing hydraulic fluid from a source at surface level into the chamber to extend the piston with respect to the cylinder and thus hold the rails tightly against the walls of the trench.

In one common shoring device of this type, the outer ends of the cylinders and rods include pads pivotally connected to the rails to permit the rails to swing between folded positions, as they are lowered into or raised from the trench, and positions generally perpendicular to the actuators, when disposed within the trench. More particularly, each pad having a bearing surface which is movable into a bearing surface on the adjacent rail to locate the actuators in their generally perpendicular positions. Thus, the rails may be lowered into and raised from the trench by holding the upper end of the uppermost of the folded rails and allowing the lower end of the lowermost rails to engage the bottom of the trench, at which time the uppermost rail need only be lowered downwardly until its lower end also touches the bottom of the trench. Preferably, the passageway connecting each pressure chamber with a fitting to which a hose may be connected is formed in the pad. When the device is to be removed from the trench, the hydraulic fluid is exhausted from the pressure chamber to relieve the force holding the actuators extended and thus permit the upper end of one of the rails to be lifted in order to swing the rails back into a folded position in which the device may be lifted from the trench. However, if the pressure of the hydraulic fluid is lost for any reason, and the rails are thus not forced tightly into engagement with the side walls of the trench, the side walls may collapse and thus injure personnel within the trench. Furthermore, there are many sources of failure of hydraulic fluid pressure in a device of this type, such as, for example, the hoses leading to the pressure chambers leak, or the fitting to which the hoses connect is damaged. Also, the seal on the piston within the cylinder may fail. Obviously, any one of these failures could cause sufficient failure of the hydraulic fluid pressure holding the rails against the side walls of the trench.

The object of this invention is to provide a device of this type which will hold the actuators extended so as to maintain the rails tightly engaged with the side walls of the trench even though hydraulic fluid pressure may be lost, and, more particularly, a device for accomplishing this object which is of simple and inexpensive construction, requiring only minor alteration of an existing shoring device and enabling the actuators to be held or released with a minimum of time and effort.

This and other objects are accomplished, in accordance with the illustrated embodiment of the present invention, by a shoring device of the type described wherein a nut is threadedly connected to the rod of each actuator intermediate its connection to an adjacent rail and the piston on the rod whereby the nut may be moved lengthwise of the rod into engagement with the cylinder adjacent its open end. Thus, in the use of this device, it may be lowered into the trench to dispose the rails opposite the side walls, following which hydraulic fluid may be supplied to the pressure chambers so as to extend the actuators and thus move the rails tightly against the side walls of the trenches, and the nuts may be turned in a direction to move them into engagement with the cylinders adjacent their open ends. As a result, even though hydraulic fluid pressure may be lost, the rod and thus the piston is prevented from contraction with respect to the cylinder so that the rails are maintained tightly against the side walls of the trench, and if desired, the hoses may be removed from the fittings on the cylinders to permit them to be used in the installation of other devices.

It will also be understood that the connection between this cylinder and rod provided by the nut will increase the column strength of the actuator considerably above that which results from the force due to hydraulic fluid acting between the piston and cylinder within the pressure chamber. Also, if it is necessary to move the rails into tighter engagement with the side walls, the nuts may be turned an additional amount in order to take up any slack between the nuts and the cylinders resulting from any tendency of the actuators to extend. On the other hand, when it is desired to remove the device, the nut need only be backed off to reduce the force urging the rails outwardly a sufficient amount to permit them to be removed from the trench.

In the drawings, wherein like reference parts are used throughout to designate like parts, FIG. 1 is an elevational view of a shoring device constructed in accordance with the present invention and held in folded position as it is lowered into a trench;

Figure 2:
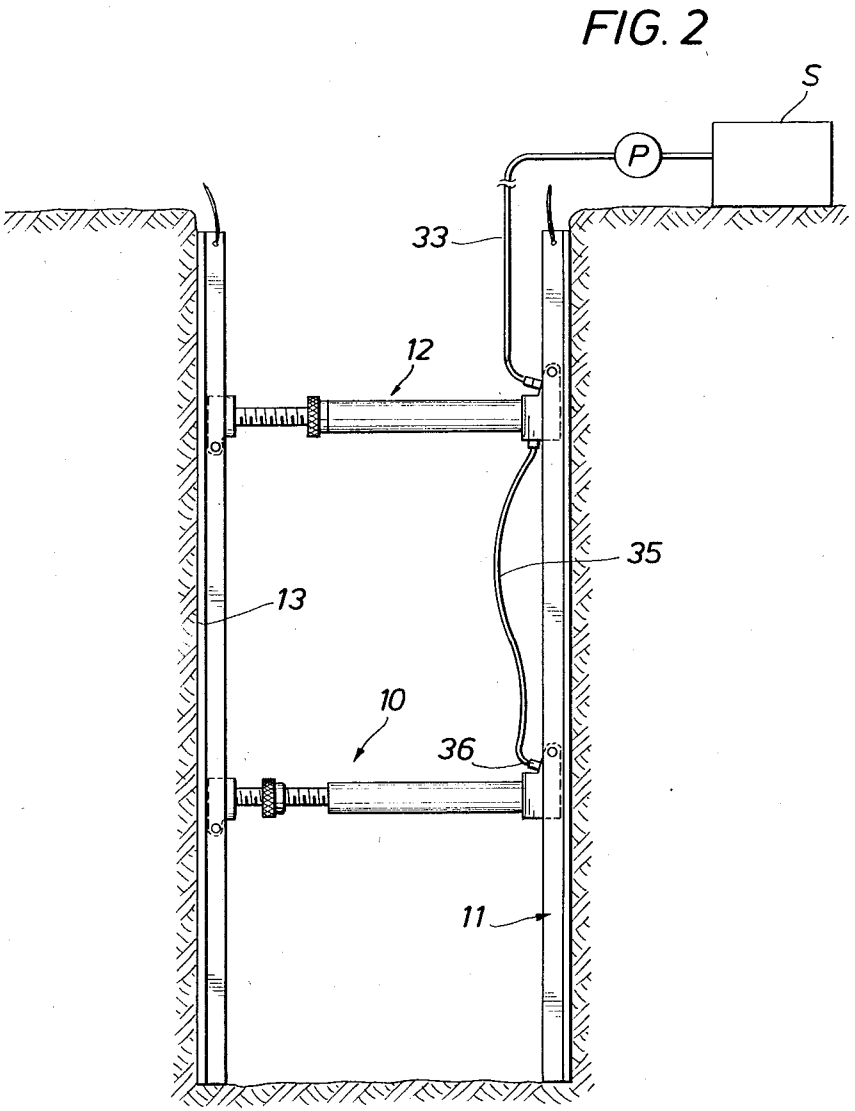
FIG. 2 is a view similar to FIG. 1, but upon lowering of both rails into the trench, and upon introduction of hydraulic fluid into the pressure chambers of the actuators to urge the rails tightly against the side walls of the trenches, the nut on one actuator being shown upon movement into a position engaged with the cylinder to prevent contraction of the actuator.
Figure 1:
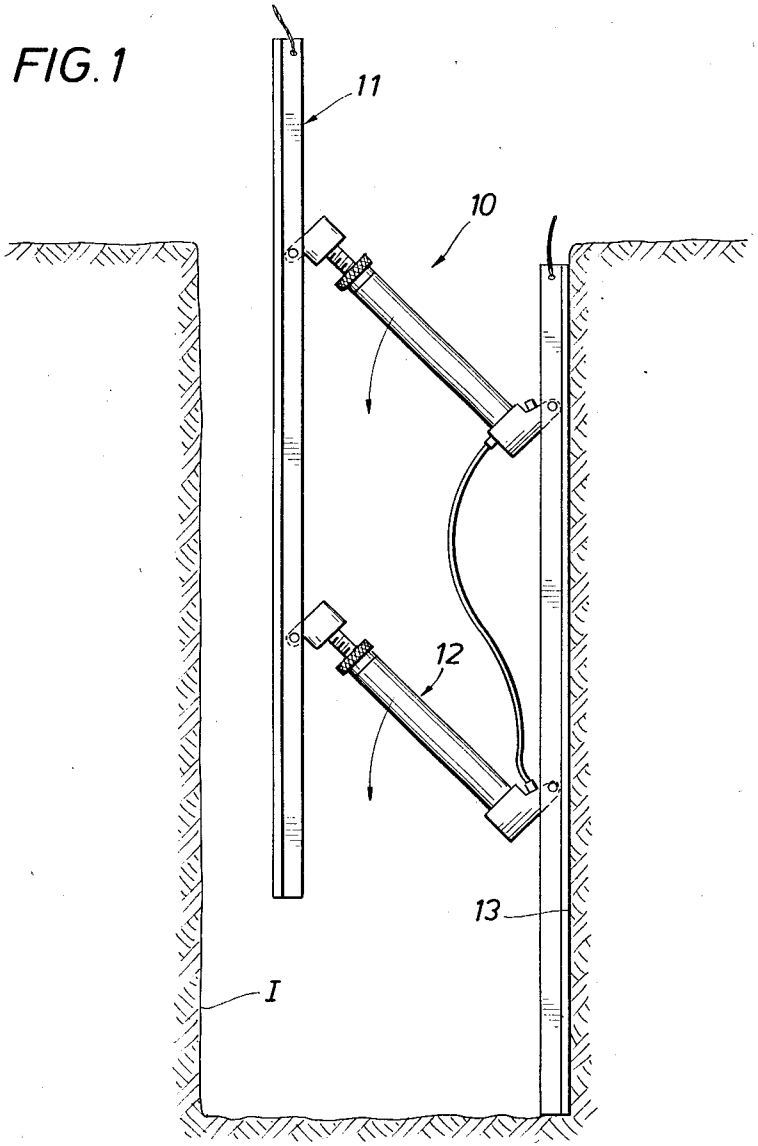

With reference now to the details of the above described drawings, the shoring device, which is indicated in its entirety by reference character 10, is shown in each of FIGS. 1 and 2 to comprise a pair of elongate rails 11 and a pair of parallel, extendible and retractible actuators 12 each connected at its opposite ends to the rails. In the illustrated shoring device, the opposite ends of the actuators are pivotally connected to the rails to permit the rails to be swung between folded positions in which, as shown in FIG. 1, they may be lowered into and raised from a trench T, and positions in which they are perpendicular to the actuators and thus in position to be moved outwardly into engagement with the side walls 13 of the trench when the actuators are extended. Thus, as indicated in FIG. 1, the device may be suspended from the upper end of the left hand rail until the lower end of the right hand rail engages the bottom of the trench, following which continued lowering of the left hand rail will permit the device to unfold until, as shown in FIG. 2, the lower end of the left hand rail also engages the bottom of the trench and the actuators assume positions perpendicular thereto.

Figure 3:
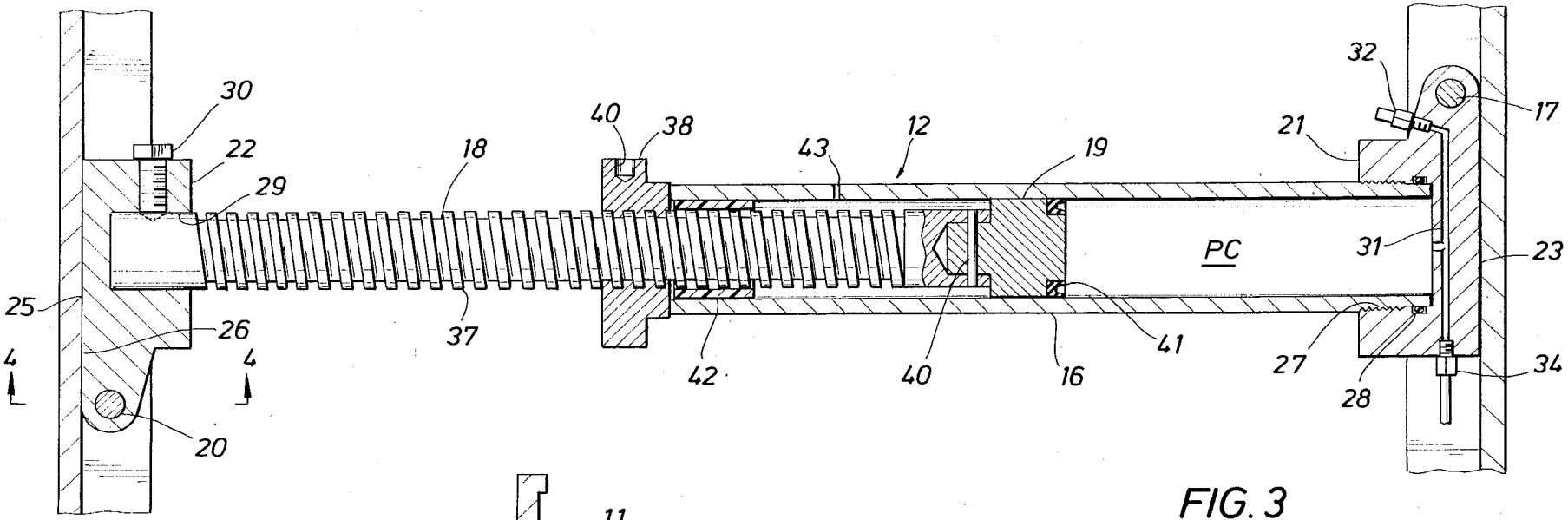
FIG. 3 is an enlarged cross-sectional view of one of the actuators.
Figure 4:
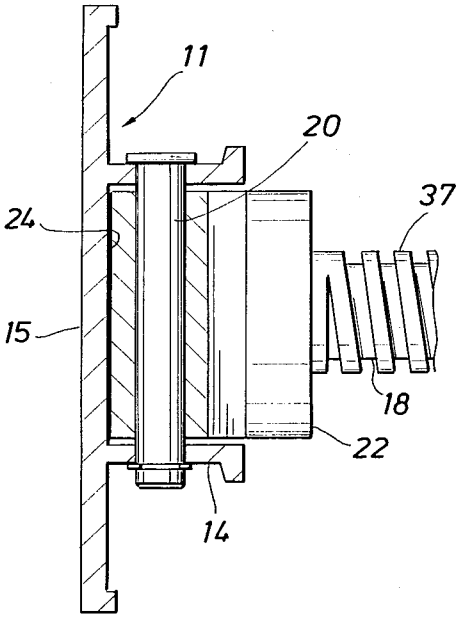
FIG. 4 is a cross-sectional view of the connection of the rod of the actuator to the adjacent rail, as seen along broken lines 4—4 of FIG. 3.

As best shown in FIG. 4, each rail 11 has a channel section 14 on the inner side of a wide outer wall 15 which is adapted to engage the side wall of the trench. As shown in FIG. 3, each actuator includes a cylinder 16 having an outer closed end pivotally connected to the right hand rail by means of a pivot pin 17 extending between the sides of channel section 14, and a rod 18 having a piston 19 on its inner end sealably slidable within the cylinder and connected at its outer end to the left hand side rail by means of a pin 20 extending between its channel section. As will be described to follow, a pressure chamber PC is thus formed between the inner end of the piston and the outer, closed end of the cylinder so that hydraulic fluid supplied thereto will extend the rod and thus the actuator.

More particularly, the outer end of each cylinder 16 is closed by a pad 21 having an upper end through which the pin 17 extends, and each rod 18 includes a pad 22 on its outer end and having a lower end through which the pin 20 extends. Pad 21 has an outer bearing surface 23 which is adapted to engage a bearing surface 24 within the channel 14 of the right-hand rail, and the pad 22 on the end of the rod 18 has a bearing surface 25 which is adapted to engage a bearing surface 26 on the channel section 14 on the left-hand rail when the device is unfolded into a position in which the actuators extend perpendicularly between the rails.

As shown in FIG. 3, the cylinder 16 includes a tubular section whose outer end is threaded for connection with a socket 27 in a recess in the inner side of the pad 21, and a seal ring 28 is received within a groove in the recess to seal between the end of the tubular section and the pad. The outer end of each rod 18, on the other hand, is received closely within a socket 29 on the inner side of each pad 22 and releasably held therein by means of a set screw 30 carried by the pad.

The pad 21 on the outer end of the cylinder 16 has a passageway 31 formed therein which connects a fitting 32 on its outer end near the upper end of the pad with the pressure chamber PC within the cylinder, and, as shown in FIG. 3, a hose 33 connects the fitting with a source S of hydraulic fluid at the surface level above the trench, whereby hydraulic fluid cab be supplied through the passageway into the pressure chamber PC. As also shown in FIG. 3, the passageway 31 also extends downwardly through the pad for connection with another fitting 34 which, as shown in FIGS. 1 and 2, in turn connects with a hose 35 leading to a fitting 36 in the pad 21 of the cylinder of the lower actuator. Although not shown, it will be understood that the fitting 26 in turn connects with a passageway in the pad of the lower actuator leading to the pressure chamber formed between that pad and the inner end of the piston of the rod reciprocal within the cylinder of the lower actuator. Thus, hydraulic fluid may be supplied to both actuators from a single source.

As previously described, and as best shown in FIG. 3, the rod 18 has threads formed thereabout intermediate its outer end fixedly connected to the pad 22 and the piston 19 on its inner end. A nut 38 is threadedly mounted on the threads 37 for movement axially of the rod 18 between a position in which the right hand end of the nut is spaced from the open end of the cylinder 16 as shown in the case of the lower actuator of FIG. 2 and a position engaged therewith as shown in the case of the upper actuator in FIG. 2, and as shown in detail in FIG. 3. When so engaged with the end of the cylinder, the nut 38 prevents contraction of the actuator, and thus maintains the rails in tight engagement with the side walls of the trench. Thus, in the installation of the device, and with the nuts moved toward the outer ends of the rods, as indicated in the case of the lower actuator of FIG. 2, hydraulic fluid is supplied to the actuators to extend them and thus urge the rails tightly against the side walls of the trench. With hydraulic fluid thus maintaining the actuators extended, the nuts are turned in a direction to move them into engagement with the outer end of the cylinder, as best shown in FIG. 3. For this purpose, a suitable tool may be inserted in a socket 40 in the side of the nut to apply mechanical advantage for turning it to a position in which it is tightly engaged with the outer end of the cylinder. Preferably, the threads 37 are of an Acme type, as illustrated in the drawings.

As shown in FIG. 3, and for assembly purposes, the inner end of the rod has a socket which receives a pin on the outer end of the piston 19, and the two are connected to one another by a pin 40 extending through them. Also, a seal ring 41 is carried within a recess about the inner end of the piston to contain the pressure of hydraulic fluid within the pressure chamber PC. Still further, a sleeve 42 of plastic or other relatively low friction material is received within the outer end of the cylinder to closely surround the threads 37 and thus protect the space about the threads and within the outer end of the cylinder against the intrustion of debris. A weep hole 43 is formed in the tubular section of the cylinder to connect this space with the exterior of the actuator and thus prevent the buildup of pressure which might resist outward movement of the piston.

From the foregoing it will be seen that this invention is one well adapted to attain all of the ends and objects hereinabove set forth, together with other advantages which are obvious and which are inherent to the shoring device.

It will be understood that certain features and subcombinations are of utility and may be employed without reference to other features and subcombinations. This is contemplated by and is within the scope of the claims.

Because many possible embodiments may be made of this invention without departing from the scope thereof, it is to be understood that all matter herein set forth or shown in the accompanying drawings is to be interpreted as illustrative and not in a limiting sense.

What is claimed is:

1. A device for shoring the side walls of a trench or the like, comprising a pair of elongate rails, a pair of parallel, extendible and contractible actuators each connected at its opposite ends to the rails for lowering and raising with the rails into and out of positions in which the rails are opposite the walls, and adapted, when extended, to hold the rails tightly against the walls, each actuator including a cylinder connected to one rail and a piston on a rod connected to the other rail and sealably reciprocable within the cylinder to form a pressure chamber between one end of the piston and a closed end of the cylinder adjacent its connection to the one rail, each cylinder having a passageway therein connecting the pressure chamber with a fitting to which a hose may be connected for introducing hydraulic fluid into the chamber for extending the piston with respect to the cylinder, and a nut threadedly connected to each rod for movement lengthwise of the rod intermediate its connection to the other rail and the piston thereon, said nut being engageable with the cylinder adjacent its open end, when moved longitudinally of the rod in one direction, so as to prevent contraction of the rod with respect to the cylinder in the event of the loss of hydraulic fluid pressure.

2. A device of the character defined in claim 1, wherein the cylinders and rods have pads on their outer ends pivotally conneeted to the rails to permit the rails to swing between folded positions, as they are lowered into or raised from the trench, and positions generally perpendicular to the actuators when disposed within the trench, and each pad has a bearing surface movable into engagement with a bearing surface on the rail to locate the actuators generally perpendicular in said positions.

3. A device of the character defined in claim 2, wherein the pad of each cylinder closes the end of the cylinder, and the passageway extends within the pad.

* * * * *